US006473915B1

(12) United States Patent
Davis et al.

(10) Patent No.: US 6,473,915 B1
(45) Date of Patent: Nov. 5, 2002

(54) HYDROTHERAPY POOL

(75) Inventors: Barry Davis, Farmingdale; William A. Stern, Scarsdale, both of NY (US)

(73) Assignee: Aqua-Eez, Inc., Yonkers, NY (US)

( * ) Notice: Subject to any disclaimer, the term of this patent is extended or adjusted under 35 U.S.C. 154(b) by 0 days.

(21) Appl. No.: 09/878,678

(22) Filed: Jun. 11, 2001

(51) Int. Cl.[7] ..... A47K 3/02
(52) U.S. Cl. ..... 4/555; 4/584; 4/556; 4/593
(58) Field of Search ..... 4/555, 556, 589, 4/590, 593, 584; 292/240, 241, 54

(56) References Cited

U.S. PATENT DOCUMENTS

| | | | | | |
|---|---|---|---|---|---|
| 182,141 | A | * | 9/1876 | Wilson | 292/241 |
| 640,750 | A | * | 1/1900 | Converse | 292/241 |
| 2,075,933 | A | * | 4/1937 | Friedlander | |
| 2,310,348 | A | * | 2/1943 | Blears | |
| 2,396,520 | A | * | 3/1946 | Mastrangelo | 160/369 |
| 3,416,166 | A | * | 12/1968 | Hanson | |
| 3,423,769 | A | * | 1/1969 | Cowley | |
| 3,616,467 | A | * | 11/1971 | Drain | |
| 3,719,960 | A | * | 3/1973 | Russell | |
| 3,863,275 | A | * | 2/1975 | Brendgord et al. | |
| 4,118,810 | A | * | 10/1978 | Brickhouse | |
| 4,583,251 | A | * | 4/1986 | Furst Karl et al. | |
| 4,796,312 | A | * | 1/1989 | Corlew | |
| 4,890,341 | A | * | 1/1990 | Forbes | |
| 5,446,929 | A | * | 9/1995 | Sills et al. | |
| 6,055,685 | A | * | 5/2000 | Norton et al. | |

FOREIGN PATENT DOCUMENTS

| | | | | |
|---|---|---|---|---|
| JP | 05123375 | A | * | 5/1993 |

* cited by examiner

*Primary Examiner*—Steven O. Douglas
*Assistant Examiner*—Khoa Huynh
(74) *Attorney, Agent, or Firm*—David Aker

(57) ABSTRACT

A hydrotherapy pool comprising an enclosure for receiving a patient and for holding a quantity of liquid sufficient for immersing the patient so that the patient receives hydrotherapy, the enclosure having a plurality of openings for facilitating entry and exit from the enclosure; a removable door for each opening; a water tight seal for each door for sealing the door to the enclosure so that water does not leak from the enclosure; and a filling and draining system for filling and draining the enclosure of water. A seating area at a first end of the pool. The pool may have three doors, the doors being disposed with respect to the patient when seated in the seating area facing the patient, to the right of the patient, and to the left of the patient. Each door may comprise a panel having a shape corresponding to the openings; a seal disposed about the periphery of the panel; at least one locking mechanism for urging the seal into contact with a portion of the enclosure associated with the opening so that the seal is trapped between the door and that portion.

19 Claims, 8 Drawing Sheets

HYDROTHERAPY POOL

BACKGROUND OF THE INVENTION

1. Field of the Invention

The present invention relates to relatively small pools useful for hydrotherapy. More particularly, it relates to such pools which may be used to partially or totally immerse a woman so as to assist in the process of labor and giving birth.

2. Prior Art

In recent years, as women have sought to have more natural and comfortable childbirth experiences, a variety of new techniques have come into relatively common use. Many women, at the suggestion of healthcare providers, or on their own initiative, have elected to have labor occur while immersed in a comfortable environment of warm water. This has many beneficial effects for the mother, including relaxing the patient, easing discomfort and reducing anxiety. Further, immersion produces buoyancy which creates a hydrodynamic lift effect, thus counteracting the effect of gravity. Since the body has an apparent weigh of only a small fraction of its weight on land, muscular tension is reduced. It is believed that this decrease in tension may also cause an increase in oxytocin and endorphins, thus creating a euphoric effect. Finally the presence of the water reduces the strain on perineal muscles and increases elasticity.

A major difficulty associated with such hydrotherapy pools is that a healthcare provider or the patient may need to enter and exit the pool repeatedly. As with any environment in which water is present, this may cause slippery conditions that can result in a fall and a consequent injury. This situation is aggravated by the pregnant condition of the patient, which may make it even more hazardous. Thus, there is a great need for a pool with convenient and safe access for the patient and the healthcare professional.

Another problem associated with hydrotherapy pools is that in many installations, large areas of hospital or birthing center floor space must be dedicated to the hydrotherapy pool. Further, the installation of appropriate plumbing connections may be complex and costly. Finally, for hygienic reasons, maintenance costs in terms of labor and materials may be high to insure that pathogens are kept under control and not transmitted from one patient to the next.

SUMMARY OF THE INVENTION

It is an object of the invention to provide a pool which may be used for hydrotherapy and which provides easy and safe access for the patient and the healthcare provider.

It is another object of the invention to provide a pool which does not require expensive installation procedures.

It is yet another object of the invention to provide a pool which is easy to clean and to maintain in an hygienic condition.

It is a further object of the invention to provide a hydrotherapy pool which is of sufficient size so that it allows the patient to assume and maintain positions which may not be possible in a full gravity environment, but not so large as to take up an excessive amount of floor space.

The invention is directed to a hydrotherapy pool comprising an enclosure for receiving a patient and for holding a quantity of liquid sufficient for immersing the patient so that the patient receives hydrotherapy, the enclosure having a plurality of openings for facilitating entry and exit from the enclosure; a removable door for each opening; a water tight seal for each door for sealing the door to the enclosure so that water does not leak from the enclosure; and a filling and draining system for filling and draining the enclosure of water.

The pool is generally of rectangular shape, and includes a seating area at a first end of the pool. The pool may have three doors, the doors being disposed with respect to the patient when seated in the seating area facing the patient, to the right of the patient, and to the left of the patient. Each door may comprise a panel having a shape corresponding to the openings; a seal disposed about the periphery of the panel; at least one locking mechanism for urging the seal into contact with a portion of the enclosure associated with the opening so that the seal is trapped between the door and the portion in a water tight manner. The locking mechanism may comprise a rotationally mounted shaft extending from a surface of the door external to the pool when the door is in place in the opening; and a circular member mounted eccentrically on the shaft, the circulat member being configured to permit gripping the member for rotation thereof, the circular member being sized, shaped and positioned so that when in a first rotational position the member engages the portion of the enclosure, and when in a second rotational position the member does not engage the portion of the enclosure. A surface of the circular member which comes into contact with the portion of the enclosure has a sloping surface, so that as the circular member is rotated from the second position to the first position, compressive force on the seal is increased.

The pool may further comprise an integral seat at a first end of the pool, the seat being shaped and positioned so that when the pool is drained, the seat drains so that water does pool on the seat. The pool may comprise a first seat at a first end of the pool, the seat having a v shaped depression therein to allow access to the perineal region of a patient sitting on the seat. The seat may be integrally formed with the enclosure. The pool may also comprise a second seat disposed at an end of the pool opposite to the first seat. The second seat may be defined by a ledge formed in the enclosure.

Also in accordance with the invention, in order to make the pool portable, the pool may include a number of wheels affixed to the enclosure so that the pool may be rolled from one location to another on the wheels. The wheels may be coupled to mountings each having a spring so that the wheels extend past a lower surface of the enclosure when the pool is empty, and the springs are compressed so that the wheels do not extend below the lower surface when the pool is not empty. The springs have characteristics so that the wheels do not extend past the lower surface if a sufficient quantity of water is in the pool.

Also in accordance with the invention, the filling and draining system includes conduits for connection to a source of hot water and to a source of cold water, and a mixing valve to mix the hot water and the cold water to produce water to be fed to the enclosure. The system includes conduits for connection to a source of hot water and to a source of cold water, the conduits having at their ends quick disconnect fittings for receiving hoses which have mating connectors to connect to the fittings in a water tight manner, and to rapidly disconnect from the fittings. The mixing valve controls temperature of water supplied to the enclosure to be in the range of 92 to 105 degrees Fahrenheit. The system further includes conduits for connection to a drain to dispose of water in the enclosure. A pump may be provided for assisting in draining water from the enclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
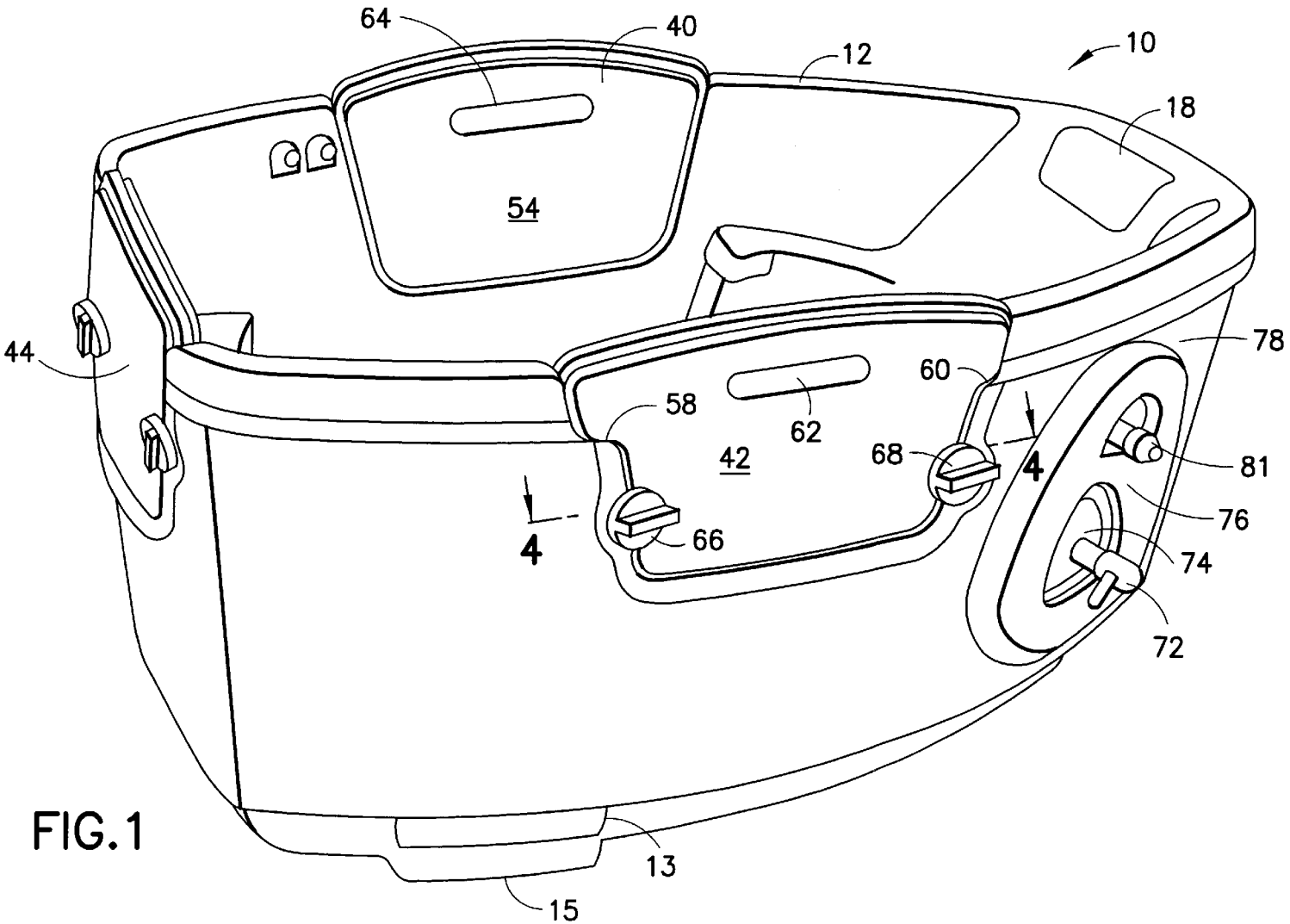
FIG. 1 is a perspective view of a pool in accordance with the invention.
Figure 2:
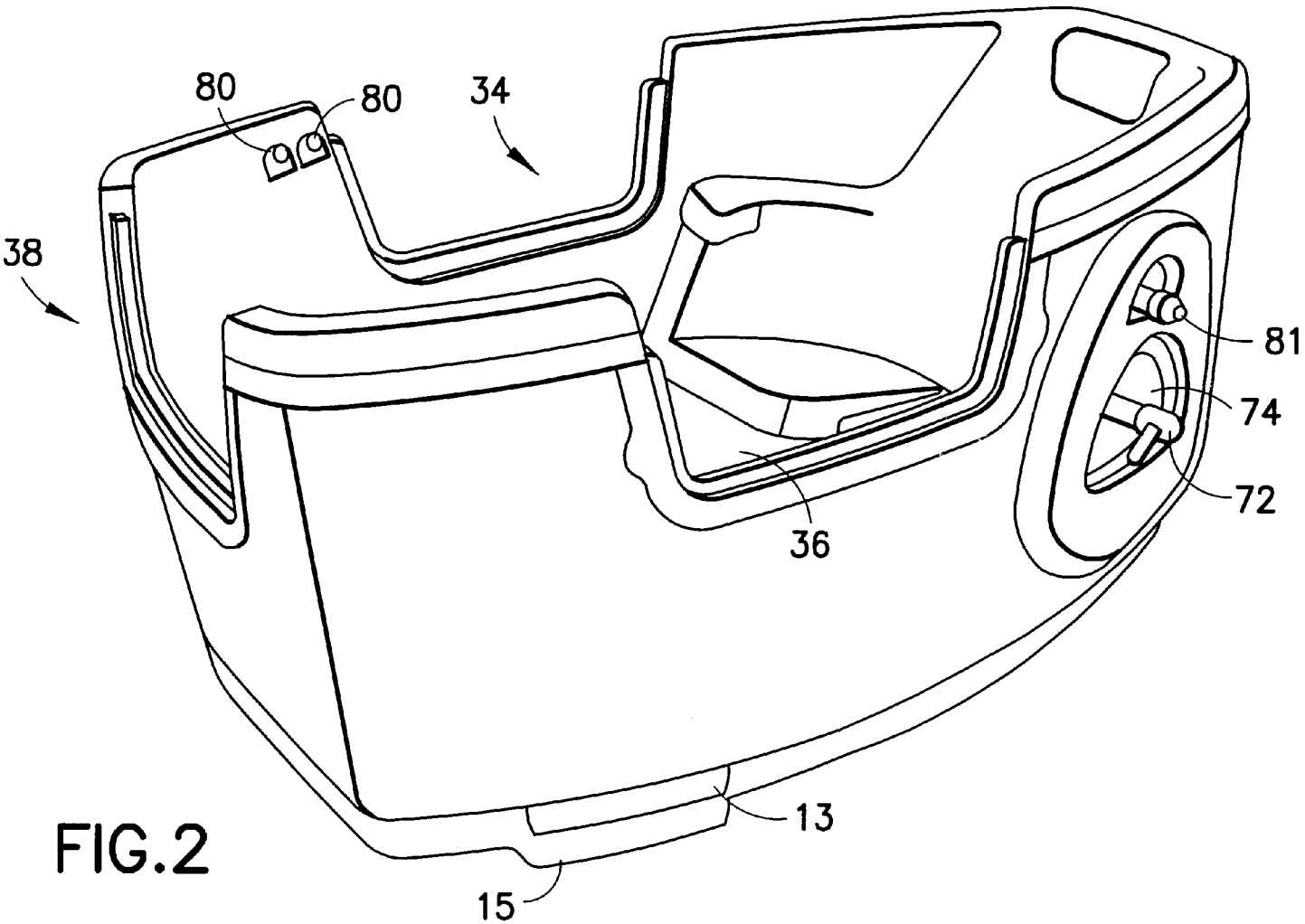
FIG. 2 is a perspective view of the pool of FIG. 1, with doors removed.
Figure 3:
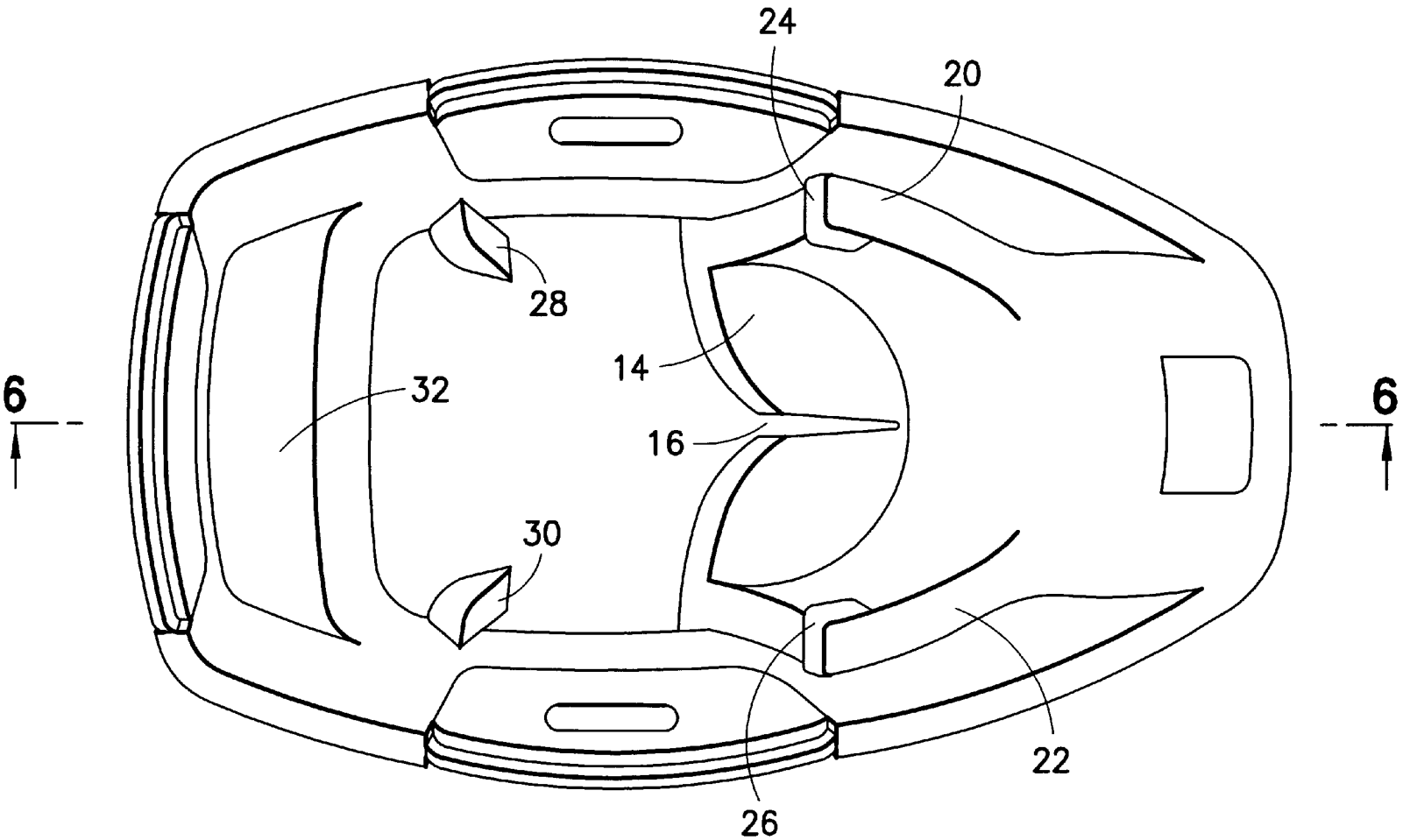
FIG. 3 is a plan view of the pool of FIG. 1.

Referring to FIGS. 1, 2 and 3, there are shown various views of a hydrotherapy pool 10 incorporating features of the present invention. Although the present invention will be described with reference to the embodiments shown in the drawings, it should be understood that the present invention may be embodied in many alternate forms of embodiments. In addition, any suitable size, shape or type of elements or materials could be used. In accordance with FIGS. 1, 2 and 3 hydrotherapy pool 10 has an enclosure 12 in the form of a generally rectangular tub formed of molded ABS with an acrylic coating which is easy to clean after use. Suitable cell foam filling may be used to provide strength and thermal insulation in the walls of enclosure 12 to assist in maintaining the temperature of water at above ambient, for example in the range of 92 to 96 degrees Fahrenheit, but never above 100 degrees Fahrenheit for hydrotherapy applications in humans. Enclosure 12 is generally larger than the size of a standard bathtub, so that the patient may be fully immersed therein if desired, while still leaving room for a healthcare giver or assistant for the patient. It is generally wider than a standard bathtub, thus allowing the patient to easily turn on her side, or assume almost any comfortable position, such as knee to chest, squatting, etc. However, the outside width dimension is advantageously slightly less than 44 inches so that a movable embodiment of the pool in accordance with the invention will fit through any regulation size hospital door. The preferred length is approximately 73 inches, while the height is under three feet. The bottom of enclosure 12 is formed into a pedestal portion 13, which is received in a steel collar assembly 15, which surrounds and strengthens the bottom of enclosure 12 and provides a support base for various other items as more specifically described below with respect to FIGS. 5, 6 and 7.

Enclosure 12 may include an integrally formed raised seat 14 on which the patient may sit. The seat center has a v-shaped depression 16 with its opening facing away from a seated patient to allow access to the perineal area. The seat is shaped so that when the water level in the enclosure is lowered, the seat is completely drained of water and no pooling of water takes place, thus enhancing the ability to drain and clean the pool. A cushioned, removable headrest 18 is positioned so that the patient may rest her head thereon. Integrally molded right side arm ledge 20 and left side arm ledge 22 each have at their respective ends a right hand grip 24 and a left hand grip 26 to assist the patient in changing or maintaining positions. Further, integrally molded right foot rest 28 and left foot rest 30, which extend upward from the bottom internal surface of enclosure 12 are provided to assist the patient in bracing herself when seated.

An integrally molded, raised, bench type seat 32 is provided at the end of enclosure 12 opposite that where the patient may sit so that a caregiver or assistant may sit on seat 32 facing the patient and provide treatment or assistance. Seat 32 may be defined by a simple ledge. Advantageously, in accordance with the invention, enclosure 12 has a right side opening 34, a left side opening 36, and a rear opening 38 which are all wide enough for the patient or caregiver to pass through. Each opening extends downward far enough so that an average adult can easily step across the edge of enclosure 12, which defines the bottom of the opening, in order to enter or exit enclosure 12. Each opening has a reduced thickness peripheral portion 39, which is used to assist in forming a water tight seal with a removable door, as explained below. As also explained below, water level may be controlled so that it is below the bottom edge of the openings when someone must enter or exit enclosure 12.

In accordance with the invention, each opening has associated with it a respective removable door, which may be placed in position and locked to the enclosure to provide a water tight seal. These doors include a right side door 40, a left side door 42 and a rear door 44.

Figure 4:
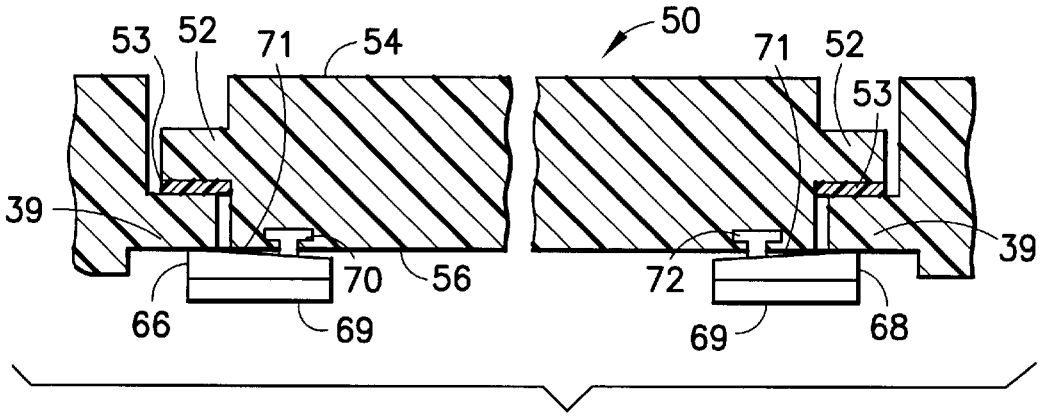
FIG. 4 is a partial cross sectional view taken along lines 4—4 of FIG. 1 with a door installed.

Referring now also to FIG. 4, each door includes a relatively thick panel 50 around which, at approximately mid thickness, is a raised annular ridge 52. Each panel, on the side 54, which faces the inside of enclosure 12, is shaped so as to be congruent with its respective opening. However, the outwardly facing surface of ridge 52 is covered with a flexible seal 53, of a sealing material such as an elastic polymer, such as a neoprene rubber, which takes up any irregularities between the surface of ridge 52 on which it is mounted, and peripheral portion 39 associated with the opening, so as to provide a water tight seal of the opening. Seal 53 is formed as an endless loop, and may be adhered to the outwardly facing surface of ridge 52 by any suitable water proof adhesive.

The side 56 of each door panel 50 opposite to side 54, which faces outwardly when the door is in place on enclosure 12, has a peripheral shape which is complementary to that of peripheral portion 39 of its respective opening. Thus, it is formed with two shoulders 58 and 60. Each door also has complementary external groove 62 and internal groove 64, which provide convenient places for gripping the doors when installing or removing them from enclosure 12.

Each door is equipped with a first locking knob 66 and a second locking knob 68 located on opposite sides thereof. Each knob 66 and 68 is generally in the shape of a disc or squat cylinder and has extending outwardly therefrom, a gripping portion 69 in the form of a rectangular solid used to grip and rotate the knob. Each knob 66 and 68 is eccentrically mounted on a respective shaft 70 and 72, which shafts are fixedly attached to panel 50, but permit rotation of knobs 66 and 68 from a first rotational position in which the knobs are clear of peripheral portion 39, to a second rotational position in which the an edge of each knob engages peripheral portion 39 and serves to lock the door in its opening.

In practice, to place and lock the doors in their respective openings, the knobs are rotated to their first positions. Then, the bottom of the door is mated to the bottom of its respective opening while the top in tilted slightly inward within the enclosure. The door is then pivoted to a vertical position so that seal 53 is in contact with the inner surface of peripheral portion 39. Then, knobs 66 and 68 are each rotated so that their underside surfaces 71, which are slightly inclined with respect to outer surface 56 of door panel 50, engage the outside surface of peripheral portion 39 of the respective opening. Due to the inclined bottom surface, the portion of each knob that engages peripheral portion 39 is thicker than the portion diametrically opposed, so that as knobs 66 and 68 are rotated from the first position to the second position, a cam action is exerted on door panel 50. This causes the side of seal 53 which is in contact with the inner surface of peripheral portion 39 to come into intimate contact with that inner surface and to compress that side of seal 53 so as to form a water tight seal. Further, as water is added to the enclosure, as described below, the hydrostatic pressure of the water also bears upon the doors, thus providing additional force, which tends to reinforce the mechanical sealing effect described above.

When a patient or caregiver wishes to leave the enclosure 12, the procedure can be reversed, after the level of water in enclosure 12 is reduced, as described below, so as to remove at least one door, and allow that person to comfortable and safely exit.

Referring again to FIGS. 1, 2, and 3, water is supplied to enclosure 12 by hoses or pipes. Internal plumbing acts as a conduit to a temperature control mixing valve 72, mounted in a recess 74 in a raised boss 76 on the side portion 78 of enclosure 12. Mixing valve 72 allows the temperature to be set within the range described above, or as high as 105 Fahrenheit, from which it may cool before use. The output of mixing valve 72 is conducted by internal plumbing to two water inlet openings 80 through which water of the selected temperature is admitted into enclosure 12. When the pool is not in use, each opening is covered by a cap (not shown) to keep it free of dirt and debris. A water level adjustment control 81, which may be a simple on-off valve, may be first opened and then closed, so as to adjust the maximum level of water in enclosure 12, as more fully described below.

In operation, enclosure 12 is filled with water to a height of only about three inches below the height of the bottom of openings 34, 36 and 38 with at least one of doors 40, 42 or 44 removed. The patient may then enter enclosure 12 and may be seated in any position. Filling only to this depth prevents overflow of water through any of openings 34, 36 and 38 from which the door has been removed, due to the displacement of water when the patient sits.

After the patient has entered enclosure 12, any missing door is secured in place, in a water tight fashion, as described above. Then, the enclosure may be filled to a water level of up to 20 inches, corresponding to a volume of 128 gallons, to provide full immersion of most patients, up to the shoulders.

If the caregiver or the patient wishes to exit enclosure 12, water is rapidly drained through a drain manifold (not shown) having a drain 82 and an overflow opening 84. Overflow opening 84 is advantageously equipped with a cable operated waste control which permits drain 82 to be opened and closed, and is manipulated to the open position to allow water to drain into the drain manifold. The drain manifold is connected to a drain line, which may be a one half inch copper tube. An electrically driven water pump may be provided externally of the pool, in a drain connection, to facilitate rapid drainage. For example, a one-half horsepower utility pump can pump up to 15 gallons of water per minute out of the pool. Within minutes, the pool may be drained to a level which permits one or more of the doors to be removed without overflow of water from the opening associated with that door. It will be understood that standard good plumbing practices should be observed, such as providing a drain trap, a screen and provision for priming the pump, if necessary, before it is started. Further, waste water must be stored and treated properly as medical waste, in accordance with applicable regulations.

The procedure for removal of a door is the opposite of that described above for its installation. First, while supporting the door panel 50 to be removed by placing fingers in grooves 62 and 64, knobs 66 and 68 on the door are rotated by means of gripping portions 69 so that they do not engage the peripheral portion 39 of the respective opening. Then the top of the door can be rotated slightly towards the interior of enclosure 12 so that it is tilted slightly away from vertical. This breaks any temporary slight adhesion of the seal 53 to the internal surface of peripheral portion 39. Then the door is simply lifted out of the opening and stored at a convenient adjacent location until it is again needed.

Figure 5:
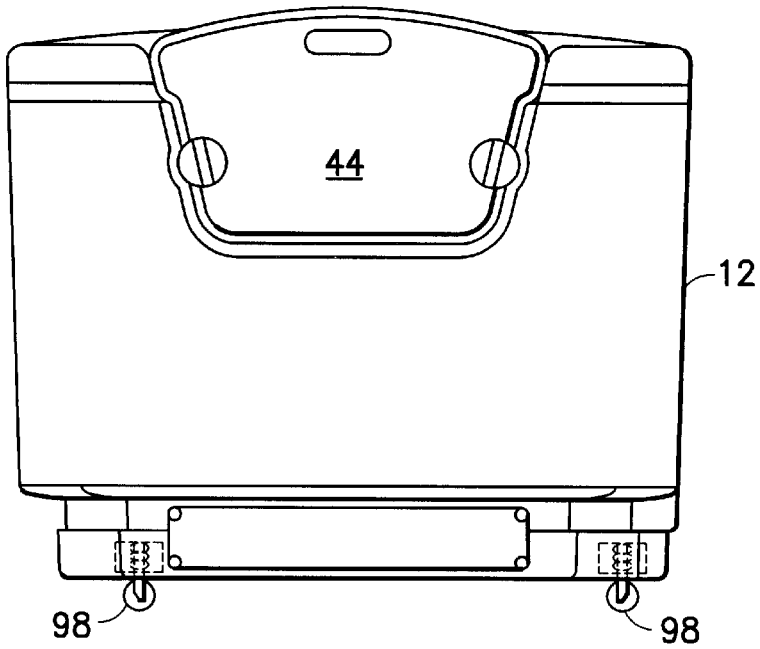
FIG. 5 is a rear elevational view of the pool of FIG. 1, with wheels in an extended position.
Figure 6:
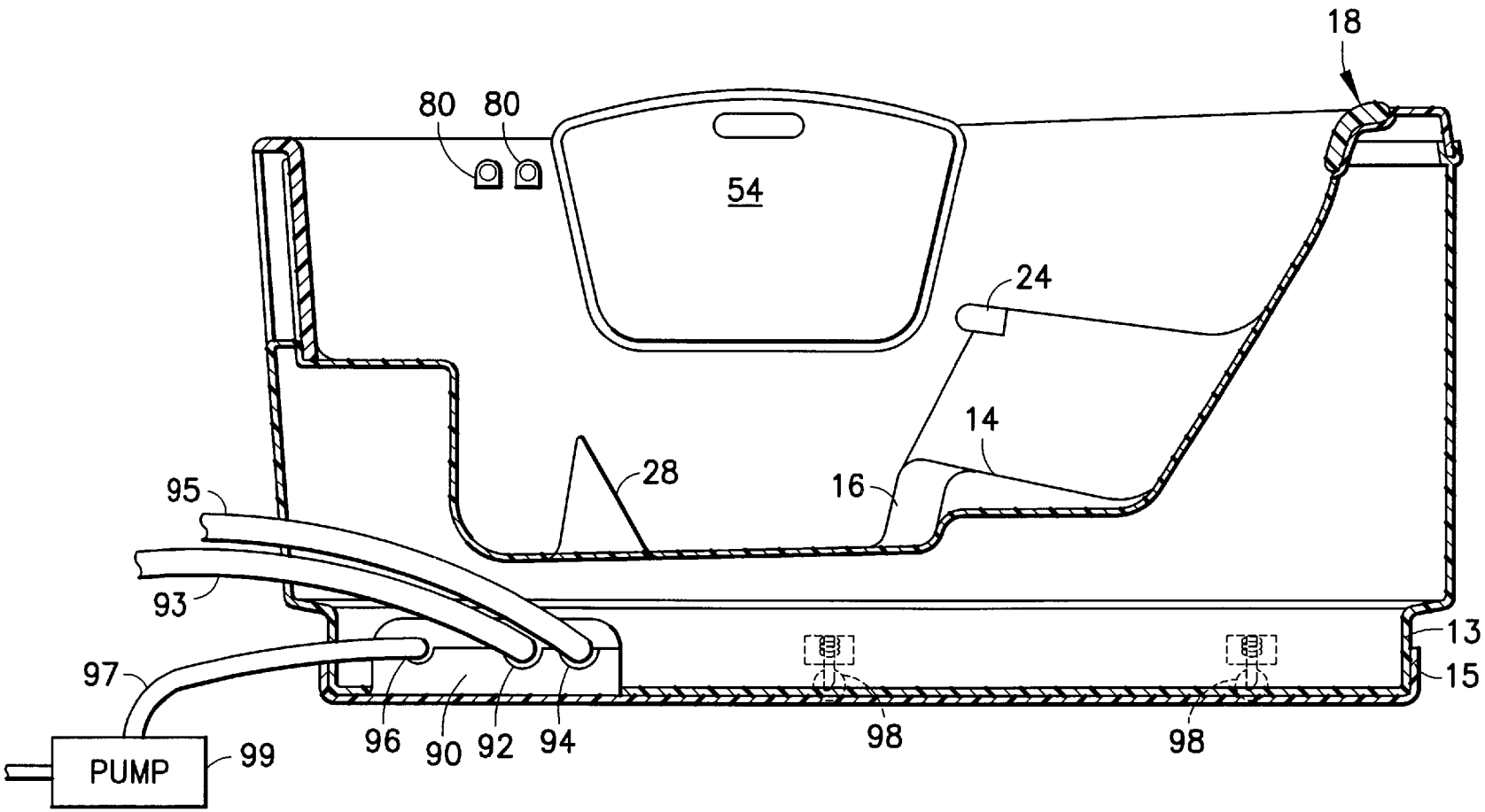
FIG. 6 is a cross sectional view of the pool of FIG. 1, taken, in general, along line 6—6 of FIG. 3, with wheels in a retracted position.
Figure 7:
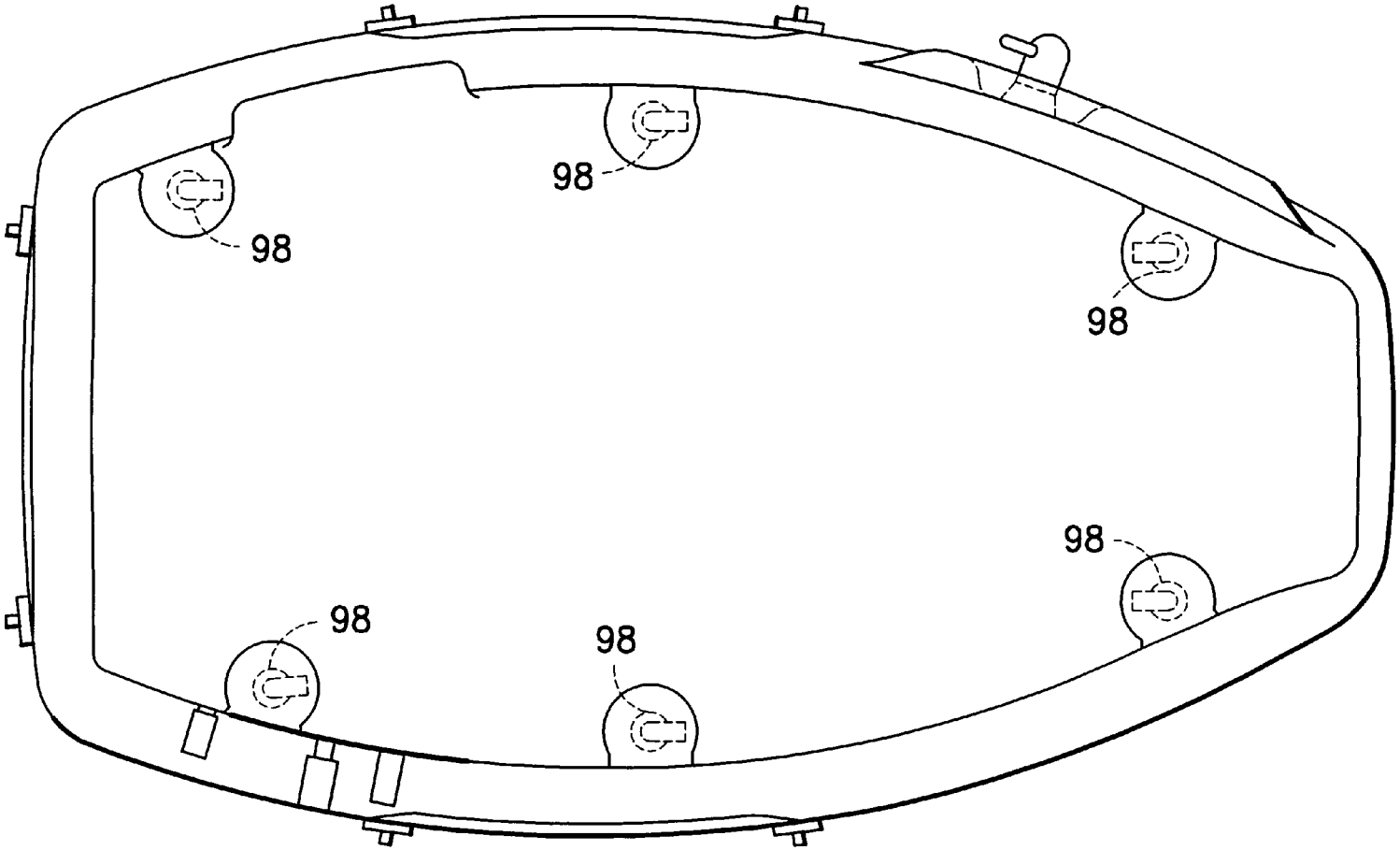
FIG. 7 is a bottom view of a movable embodiment of the pool of FIG. 1.

The present invention may be produced in at least two different embodiments. Reference is made to FIGS. 5, 6 and 7 for a description of a movable version of the pool of the present invention. As noted above, this version has the advantage of not requiring an expensive fixed plumbing installation. Further the dimensions are such that the pool can be moved through regulation sized hospital doorways.

Collar 15, which externally and internally surrounds and receives the lower wall portion of pedestal portion 13 of enclosure 12, is configured with a hose connection panel 90. Referring to FIG. 6, panel 90 has mounted thereon, hydraulic quick connection and disconnection fittings 92 and 94, for hot water hose 93 and cold water hose 95, respectively. The hoses have mating quick disconnection fittings, to provide added ease in portability. The ends not connected to the pool may be connected to similar fittings on a "T" connector attached to the faucets of a utility sink (not shown). As noted above, internal plumbing connections conduct the supplied water to valve 74. Panel 90 also has, mounted thereon, a drain outlet connection 96 to which a discharge hose 97 may be connected in order to drain the pool as described above, with a pump 99.

Referring specifically to FIG. 7, in this movable embodiment of the invention, six spring loaded wheels 98 are affixed the internal wall of collar 15. When enclosure 12 is empty, the collective force exerted by the springs is sufficient for the bottom of the wheels to extend past the bottom of collar 15 so that the pool is supported on the wheels 96. The pool may then be moved over any relatively smooth surface from one location to another. As soon as appropriate hose are connected to supply clean water to the pool and to drain waste water from the pool, use of the pool at a new location may commence. As soon as a significant quantity of water is placed in the pool, the springs are compressed, and the bottom of collar 15 contacts the surface on which the pool has been placed. This serves to temporarily anchor the pool to its present location. When no one is in the pool, and the water is drained therefrom, the springs are able to expand, and the pool is lifted so that the bottom of collar 15 is no longer in contact with the supporting surface. The hoses may be disconnected, and the pool may then be moved to a new location. Provided that the proper cleaning procedures have been observed, the pool is again ready for use, as soon as new connections are made for the water supply and drainage hoses.

Figure 8:
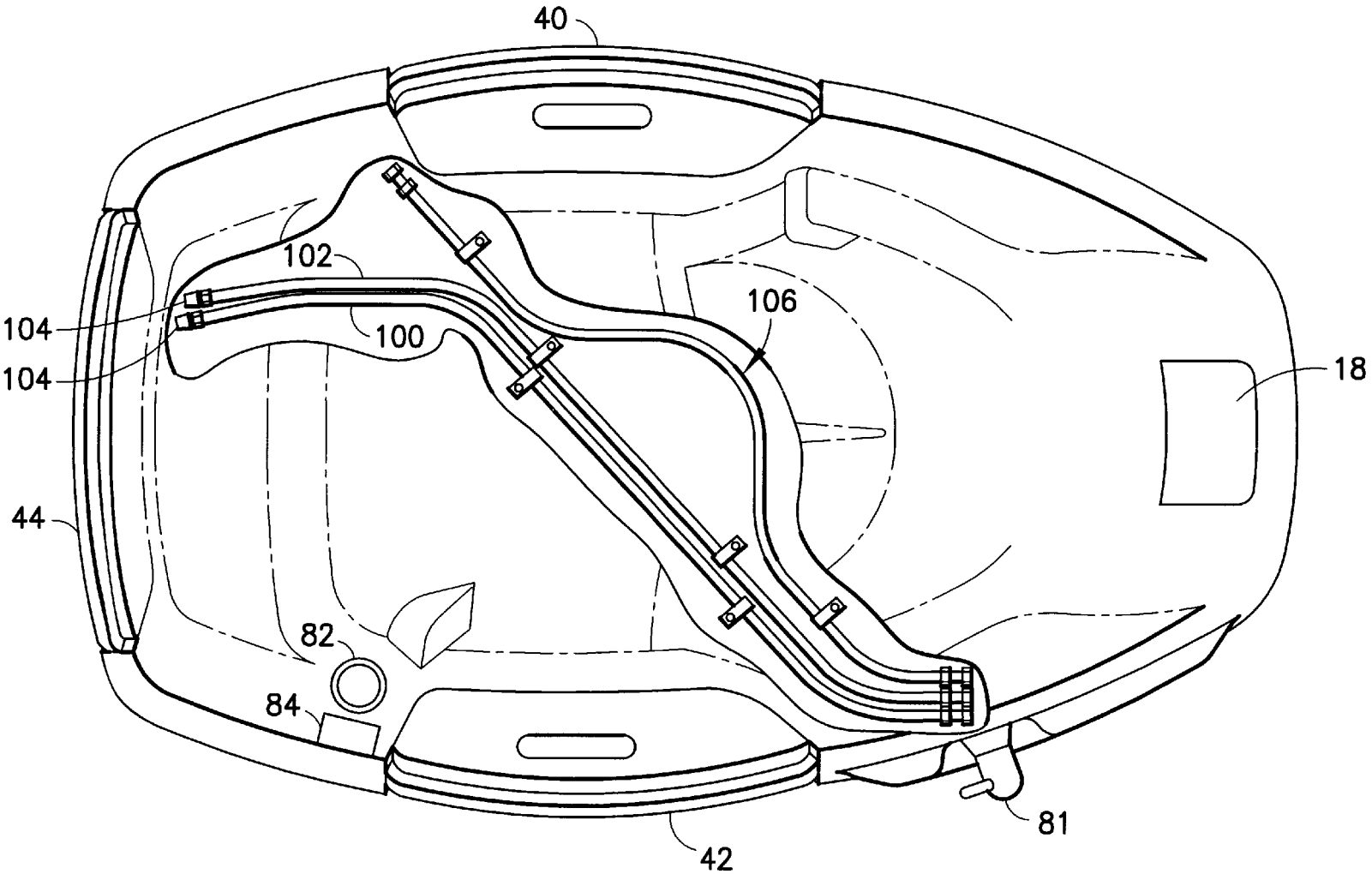
FIG. 8 is a plumbing diagram of a fixed embodiment of the pool of FIG. 1.

FIG. 8 illustrates another embodiment of the invention which is intended for use in fixed installations. Instead of a hose connection panel 90, internal plumbing lines 100 and 102 for hot and cold water, respectively, which extend from mixing valve 74, simply terminate in one half inch compression fittings, which are connected to standard, copper one half inch hot and cold water lines which are permanently installed as a part of the plumbing system of the building in which the pool is located. Another water line 106 extends from the output of valve 74 to the water inlets 80 to provide water to enclosure 12, as described above. A suitable drain line (not shown) must be connected to the drain manifold to drain the enclosure, as required. The pool may be secured to the floor with two identical stainless steel "Z" brackets (not shown) . A first of the brackets is mounted on the floor, and the pool is then pushed into position to engage that bracket. An access panel (not shown) is provided to secure the other bracket to the floor and to the pool.

It will be recognized that the weight of the pool filled with water, is fairly high. It should be installed only in locations which can support a weight of at least 1,500 pounds acting on an area the size of the bottom of the pool.

Figure 9:
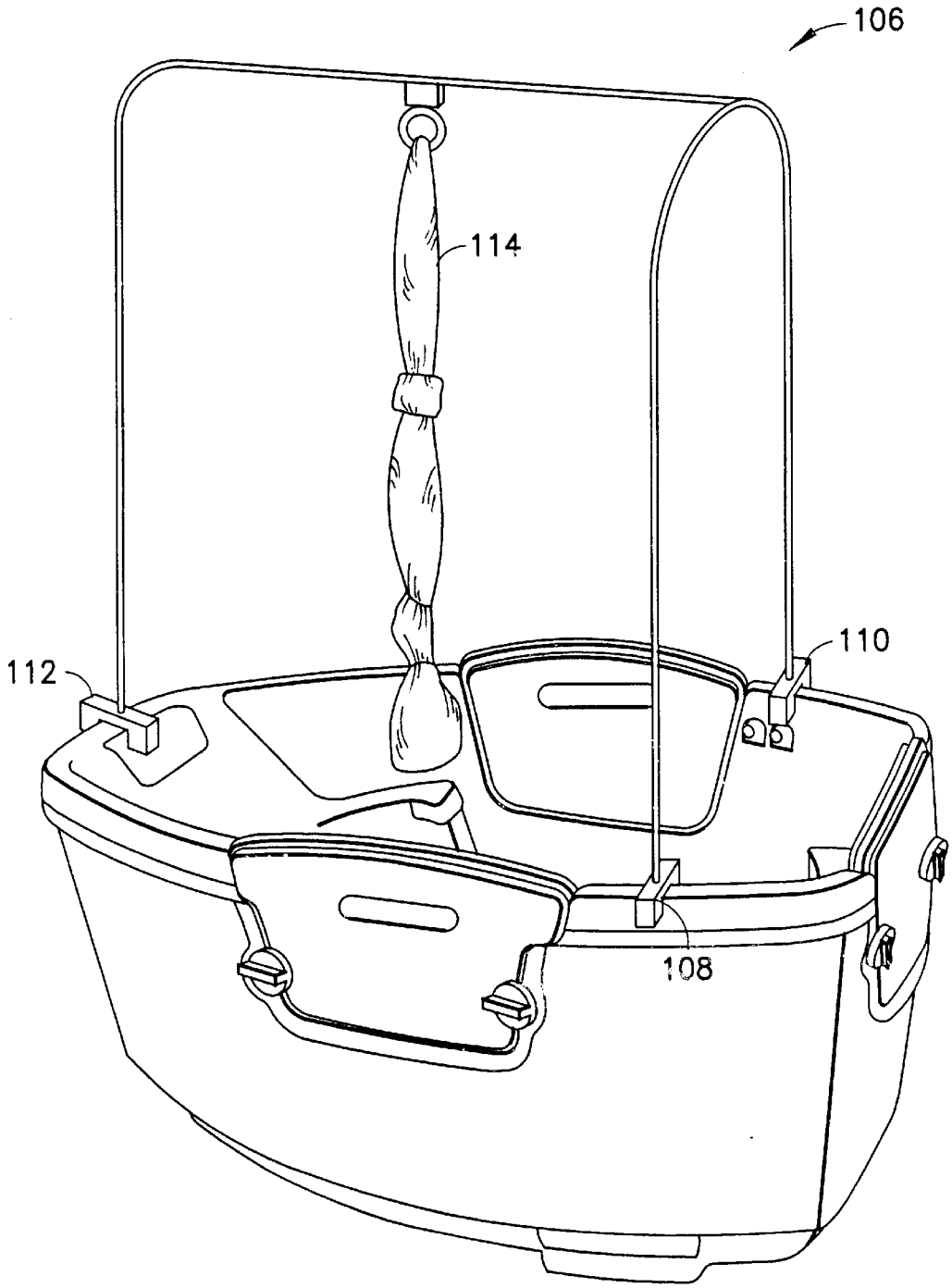
FIG. 9 is perspective view of the pool of FIG. 1 with a grab rail assembly in place.

Various accessories may be provided with the hydrotherapy pool in accordance with the invention. Referring to FIG. 9, a grab rail or support system in the form of a trapeze like structure 106 can be removably affixed to the walls of enclosure 12 by forked shaped gripping members 108, 110 and 112 at three points so as to extend over the pool as shown. While providing some assistance to the patient or caregiver in changing position, entering or exiting enclosure 12, or otherwise maneuvering, this structure may be configured for receiving a rope or towel loop 114. Loop 114 may be of assistance for any of the following: grabbing on to during entrance or egress to the pool or when changing position, or for grabbing onto during labor discomfort, or for help in "pushing", an essential assist that the patient provides during the labor process.

It will be appreciated that the movable embodiment of the present invention addresses the problem of costly installation and reduction of services by bringing the hydrotherapy pool to the patient. Thus, the hospital has accomplished the goal of having the service available to all its patients without restrictive cost factors. Also, in accordance with the invention, a safety system is in place, as built in pools often restrict accessibility for the care provider to the patient. The free standing design of the hydrotherapy pool of the present invention allows several care providers to share the burden of accessing and removing the patient in an emergency situation. Further, the free standing nature of the pool permits it to take up less valuable floor space. It drastically reduces cost. When there is no choice but to build pools into each and every room, the cost factor can be prohibitive. In the struggle to maintain budget restraints hospitals are forced to sacrifice services to patients. Due to the high cost factors, hospitals are forced to deny patients the option of hydrotherapy. However, with the present invention, multiple, fixed installations may be avoided, with a single unit being used at multiple locations to provide hydrotherapy to several patients in succession.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hydrotherapy pool comprising:

an enclosure for receiving a patient and for holding a quantity of liquid sufficient for immersing said patient so that said patient receives hydrotherapy, said enclosure having a plurality of openings for facilitating entry and exit from said enclosure;

a removable door for each opening;

a water tight seal for each door for sealing the door to the enclosure so that water does not leak from said enclosure; and a filling and draining system for filling and draining said enclosure of water;

wherein each door comprises:

a panel having a shape corresponding to said openings;

a seal disposed about the periphery of said panel; and at least one locking mechanism for urging said seal into contact with a portion of the enclosure associated with said opening so that the seal is trapped between said door and said portion in a water tight manner, wherein said locking mechanism comprises:

a shaft extending from a surface of said door external to said pool when said door is in place in said opening; and a circular member mounted eccentrically on said shaft for rotation, said circular member being sized, shaped and positioned so that when in a first rotational position said member engages said portion of said enclosure, and when in a second rotational position said member does not engage said portion of said enclosure; wherein a surface of said circular member which comes into contact with said portion of said enclosure has a sloping surface, whereby when said circular member is rotated from said second position to said first position, compressive force on said seal is increased.

2. The pool of claim 1 formed in a generally rectangular shape, further comprising a seating area at a first end of said pool.

3. The pool of claim 2 having three doors, the doors being disposed with respect to the patient when seated in said seating area: facing the patient, to the right of said patient, and to the left of said patient.

4. The pool of claim 1, further comprising:

an integral seat at a first end of said pool, said seat being shaped and positioned so that when said pool is drained, said seat drains so that water does pool on said seat.

5. The pool of claim 1, further comprising:

a first seat at a first end of said pool, said seat having a v shaped depression therein to allow access to the perineal region of a patient sitting on said seat.

6. The pool of claim 5, wherein said seat is integrally formed with said enclosure.

7. The pool of claim 5, further comprising:

a second seat disposed at an end of said pool opposite to said first seat.

8. The pool of claim 7, wherein said second seat is defined by a ledge formed in said enclosure.

9. The pool of claim 1, including a number of wheels affixed to said enclosure so that the pool may be rolled from one location to another on said wheels.

10. The pool of claim 9, wherein said wheels are coupled to mountings each having a spring so that said wheels extend past a lower surface of said enclosure when the pool is empty, and said springs are compressed so that said wheels do not extend below said lower surface when said pool is not empty.

11. The pool of claim 10, wherein said springs have characteristics so that said wheels do not extend past said lower surface if a sufficient quantity of water is in said pool.

12. The pool of claim 1, wherein said system includes conduits for connection to a source of hot water and to a source of cold water, and a mixing valve to mix said hot water and said cold water to produce water to be fed to said enclosure.

13. The pool of claim 12, wherein said mixing valve controls temperature of water supplied to said enclosure to be in the range of 92 to 105 degrees Fahrenheit.

14. The pool of claim 1, wherein said system includes conduits for connection to a source of hot water and to a source of cold water, said conduits having at their ends quick disconnect fittings for receiving hoses which have mating connectors to connect to said fittings in a water tight manner, and to rapidly disconnect from said fittings.

15. The pool of claim 1, wherein said system includes conduits for connection to a drain to dispose of water in said enclosure.

16. The pool of claim 15, further comprising a pump for He assisting in draining water from said enclosure.

17. The pool of claim 1, further comprising a support structure removably affixed to said enclosure and extending over said enclosure.

18. The pool of claim 1, wherein said shaft is rotationally mounted on said door.

19. The pool of claim 1, wherein said circular member is configured to permit gripping of said circular member for rotation thereof.

* * * * *